US008256944B2

(12) United States Patent
Yasuda

(10) Patent No.: US 8,256,944 B2
(45) Date of Patent: Sep. 4, 2012

(54) VEHICLE LAMP

(75) Inventor: Yuji Yasuda, Shizuoka (JP)

(73) Assignee: Koito Manufacturing Co., Ltd., Tokyo (JP)

( * ) Notice: Subject to any disclaimer, the term of this patent is extended or adjusted under 35 U.S.C. 154(b) by 503 days.

(21) Appl. No.: 12/478,124

(22) Filed: Jun. 4, 2009

(65) Prior Publication Data

US 2009/0303742 A1 Dec. 10, 2009

(30) Foreign Application Priority Data

Jun. 6, 2008 (JP) ..... 2008-148932

(51) Int. Cl.
*B60Q 1/00* (2006.01)

(52) U.S. Cl. ..... 362/547; 362/294; 362/373

(58) Field of Classification Search ..... 362/547, 362/373, 294
See application file for complete search history.

(56) References Cited

U.S. PATENT DOCUMENTS 4,729,076 A * 3/1988 Masami et al. ..... 362/235
2007/0008727 A1* 1/2007 Chinniah et al. ..... 362/294
2007/0091632 A1* 4/2007 Glovatsky et al. ..... 362/547
2009/0059594 A1* 3/2009 Lin ..... 362/294

FOREIGN PATENT DOCUMENTS

JP 2006-286395 A 10/2006

* cited by examiner

*Primary Examiner* — Julie Shallenberger
(74) *Attorney, Agent, or Firm* — Sughrue Mion, PLLC

(57) ABSTRACT

There is provided a vehicle lamp. The vehicle lamp includes a lamp body including a hole portion therein; an outer lens, attached to the lamp body to form a lamp chamber; a lamp unit provided in the lamp chamber and including a light emitting element serving as a light source; a heat sink; and a fan. The heat sink includes a base portion fitted into the hole portion of the lamp body; outer fins disposed on a surface of the base portion and extending outside of the lamp body; and inner fins disposed on another surface of the base portion and extending into the lamp chamber. The fan moves air in the lamp chamber toward the inner fins, which are configured such that the air passing between the respective inner fins is guided toward the outer lens.

17 Claims, 2 Drawing Sheets

VEHICLE LAMP

This application claims priority from Japanese Patent Application No. 2008-148932, filed on Jun. 6, 2008, the entire contents of which are herein incorporated by reference.

BACKGROUND OF THE INVENTION

1. Technical Field

The present disclosure relates to vehicle lamps, and more particularly, to vehicle lamps that use a semiconductor light emitting element as a light source.

2. Related Art

In the past, a vehicle lamp using a semiconductor light emitting element such as an Light Emitting Diode (LED) as a light source has been known. In the case where the semiconductor light emitting element is used as the light source of the vehicle lamp, it is necessary to satisfy a light intensity level required for the vehicle lamp by maximally using the light emission of the semiconductor light emitting element.

In general, when a large amount of current is supplied to the semiconductor light emitting element in order to obtain the high output, heat generated from the semiconductor light emitting element increases. However, when the temperature of the semiconductor light emitting element becomes high, the efficiency of light emission decreases. For this reason, in order to efficiently radiate the heat generated from the semiconductor light emitting element, various heat radiation structures for a vehicle lamp have been proposed (see e.g., JP-A-2006-286395).

However, in the related art vehicle lamp described in JP-A-2006-286395, since a natural convection current occurs in the lamp chamber where the LED is provided, the related art vehicle lamp has a disadvantage in that the circulation of air in the lamp chamber is not particularly efficient.

SUMMARY OF THE INVENTION

Exemplary embodiments of the present invention address the above disadvantages and other disadvantages not described above. However, the present invention is not required to overcome the disadvantages described above, and thus, an exemplary embodiment of the present invention may not overcome any disadvantages described above.

Accordingly, it is an aspect of the present invention to provide a vehicle lamp capable of efficiently radiating heat generated from a semiconductor light emitting element.

According to one or more illustrative aspects of the present invention, there is provided a vehicle lamp comprising a lamp body comprising a hole portion therein; an outer lens, attached to the lamp body to form a lamp chamber; a lamp unit provided in the lamp chamber and comprising a light emitting element serving as a light source; a heat sink; and a fan. The heat sink comprises a base portion fitted into the hole portion of the lamp body; a plurality of outer fins disposed on a surface of the base portion and extending outside of the lamp body; and a plurality of inner fins disposed on another surface of the base portion and extending into the lamp chamber. The fan moves moves air in the lamp chamber toward the inner fins, and the inner fins are configured such that the air passing between the respective inner fins is guided toward the outer lens.

DETAILED DESCRIPTION OF EXEMPLARY EMBODIMENTS OF THE INVENTION

Hereinafter, an exemplary embodiment of the invention will now be described with reference to the accompanying drawings.

Figure 1:
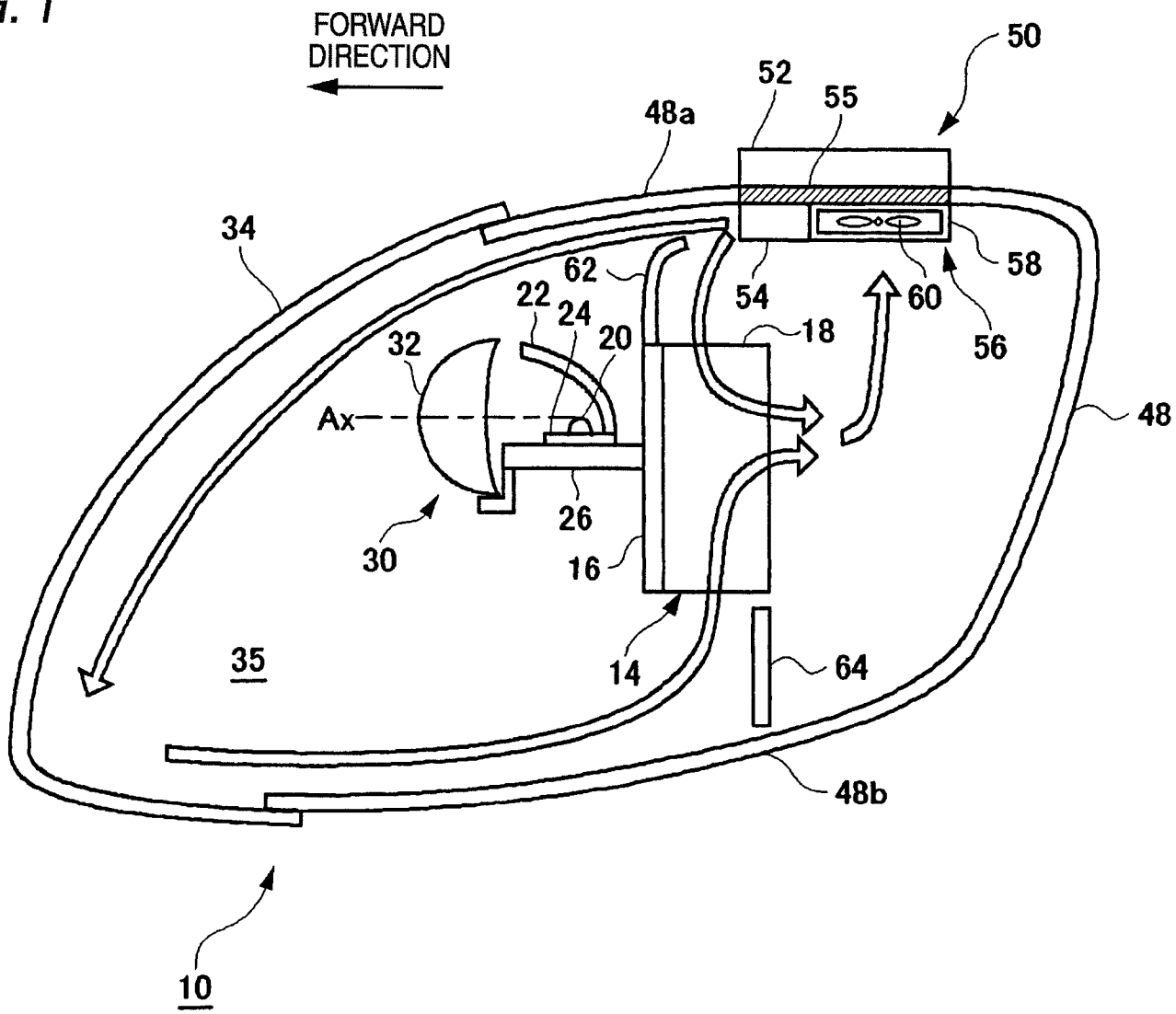
FIG. 1 is a schematic sectional view showing a vehicle lamp according to an exemplary embodiment of the invention.

FIG. 1 is a schematic sectional view showing a vehicle lamp 10 according to an exemplary embodiment of the present invention. As shown in FIG. 1, the vehicle lamp 10 has a configuration in which a lamp unit 30 using a semiconductor light emitting element as a light source is accommodated in a lamp chamber 35. The lamp chamber 35 includes a resinous lamp body 48 of which the front surface is opened and an outer lens 34 which is formed of a light transmitting material and hermetically covers the front surface of the lamp body 48. The vehicle lamp 10 includes a first heat sink 14, a second heat sink 50, and a fan 56 in addition to the lamp unit 30.

The lamp unit 30 is a so-called projector-type lamp unit using an LED as a light source. In the example shown in the drawing, the number of lamp units 30 is one, but a plurality of lamp units 30 may be provided.

The lamp unit 30 includes an LED 20, a thermal conductive insulating substrate 24, a reflector 22, a fixed member 26, and a projection lens 32. The LED 20 is a white LED including an LED chip (not shown) and a cap which is formed in a substantially semi-spherical shape so as to cover the LED chip. The LED 20 is disposed on the thermal conductive insulating substrate 24 formed of ceramic or the like. The LED 20 is disposed on an optical axis Ax such that a light emitting direction thereof is perpendicular to the optical axis Ax of the lamp unit 30. Power is supplied to the LED 20 via an interconnection pattern formed in the thermal conductive insulating substrate 24.

The reflector 22 is formed of, for example, polycarbonate so as to have a semi-dome shape, and is disposed above the LED 20. The inner upper surface of the reflector 22 is provided with a reflection surface which reflects light generated from the LED 20 in a forward direction so that the light is concentrated in the vicinity of the optical axis Ax.

The projection lens 32 is formed as a plane-convex non-spherical lens of which the front surface is a convex surface and the rear surface is a flat surface so that a light source image formed in a rear focal surface is irradiated in a forward direction as an inverse image. The fixed member 26 is formed of metal mainly containing aluminum by die-casting, and is formed in a substantially flat plate shape by extending the metal, where the upper surface thereof is mounted with the reflector 22 and the substrate 24 equipped with the LED 20. In addition, the front end of the fixed member 26 is attached with the projection lens 32.

The rear end of the fixed member 26 is attached to the first heat sink 14 provided in the lamp chamber 35. The first heat sink 14 radiates heat generated from the LED 20 to air in the lamp chamber 35.

The first heat sink 14 is formed of high thermal conductive metal such as aluminum, and includes a base portion 16 and a plurality of flat plate fins 18. The base portion 16 is a member formed in a rectangular flat plate shape, where the long side thereof is aligned in a vertical direction and the short side thereof is aligned in a horizontal direction.

The rear surface of the base portion 16 is attached with the fixed member 26 of the lamp unit 30. In addition, the plurality of flat plate fins 18 is uprightly formed in the front surface of the base portion 16 in parallel with a given gap interposed therebetween. The flat plate fins 18 are formed such that an extension direction thereof is aligned in the vertical direction. The extension direction of the flat plate fins 18 represents a longitudinal direction of the flat plate fins 18.

The lamp unit 30 and the first heat sink 14 are attached to a support member (not shown) in the lamp chamber 35 so that light emitted from the lamp unit 30 is irradiated in a forward direction of the vehicle lamp 10. In this exemplary embodiment, the lamp unit 30 and the first heat sink 14 are provided in the vicinity of the center of the lamp chamber 35.

An upper surface 48*a* of the lamp body 48 is provided with the second heat sink 50. The second heat sink 50 is disposed in a fan case 58 at the almost center in a transverse direction of the lamp body 48, and is disposed on the rear side of the base portion 16 of the first heat sink 14 in a longitudinal direction.

The second heat sink 50 includes a plurality of outer fins 52, a plurality of inner fins 54, and a base portion 55. The base portion 55 of the second heat sink 50 is hermetically fitted and fixed to a hole portion provided in the upper surface 48*a* of the lamp body 48. The outer fins 52 are uprightly formed in the upper surface of the base portion 55 and extend toward the outside of the lamp chamber 35. The inner fins 54 are uprightly formed in the lower surface of the base portion 55 and extend toward the inside of the lamp chamber 35. In addition, the fan 56 is provided below the second heat sink 50.

Figure 2:
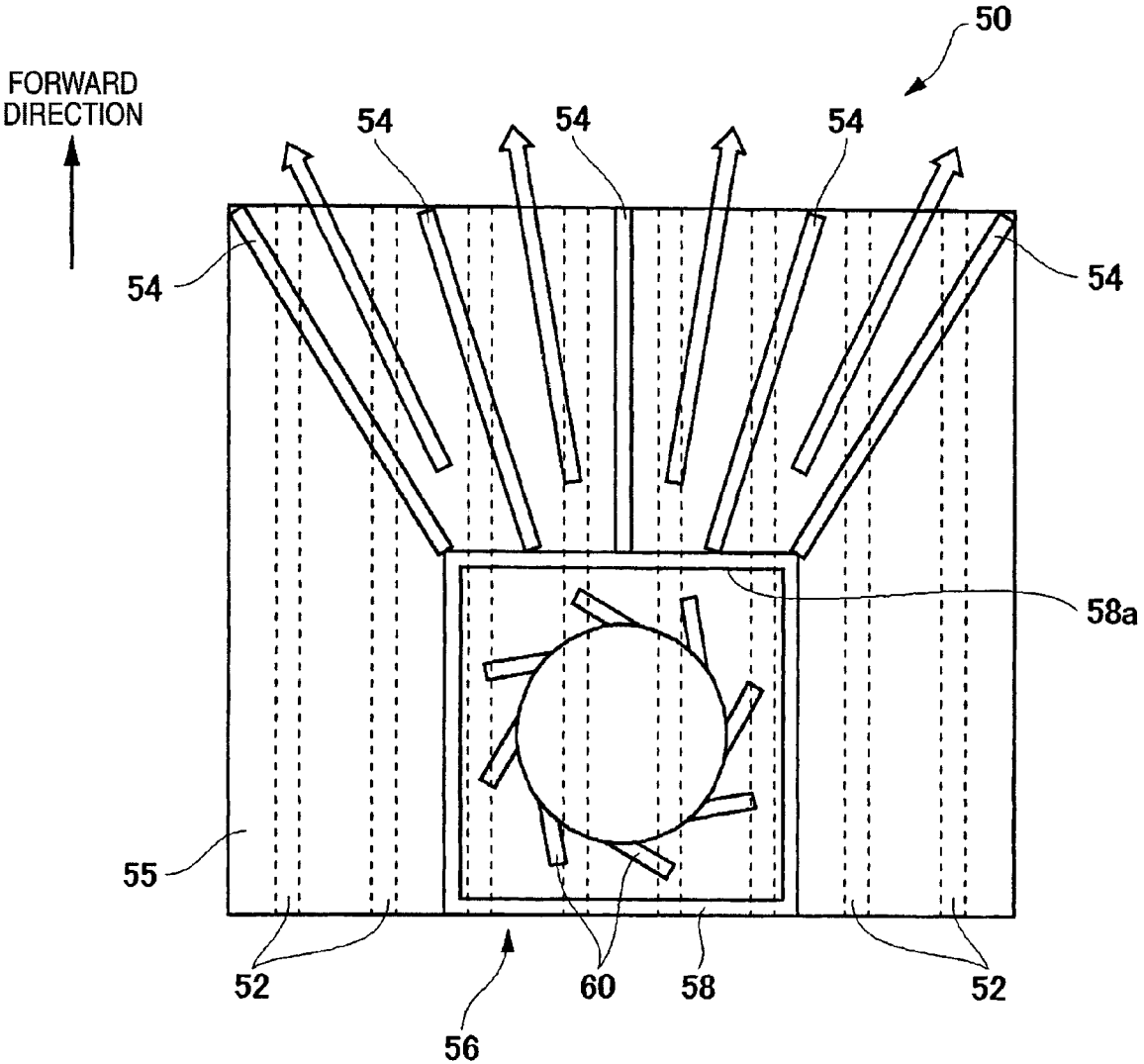
FIG. 2 is a view showing a second heat sink of the vehicle lamp of FIG. 1.

FIG. 2 is a view showing the second heat sink 50. FIG. 2 shows the shape when the second heat sink 50 is viewed from the inside of the lamp chamber 35. In addition, in FIG. 2, the outer fins 52, which are uprightly formed toward the outside of the lamp chamber 35 are depicted using dotted lines for the description thereof.

The second heat sink 50 is formed of high thermal conductive metal such as aluminum. As described above, the plurality of outer fins 52 are uprightly formed in the upper surface of the square base portion 55 and extend toward the outside of the lamp chamber 35. Each of the plurality of outer fins 52 is a flat plate fm, and the plurality of outer fins 52 are uprightly formed in parallel with a given gap interposed therebetween. As shown in FIG. 2, the extension direction of the outer fins 52 is aligned in a longitudinal direction (i.e., a forward direction indicated in FIG. 2). The extension direction of the outer fins 52 represents a longitudinal direction of the outer fins 52.

As shown in FIG. 2, the lower surface of the base portion 55 is provided with the plurality of inner fins 54 and the fan 56. The inner fins 54 are uprightly formed in the front half surface of the lower surface of the base portion 55 toward the inside of the lamp chamber 35. The fan 56 is provided on the rear half surface of the lower surface of the base portion 55.

In this exemplary embodiment, the fan 56 is a centrifugal fan which sucks air in an axial direction and exhausts the air in a centrifugal direction. The fan 56 includes the fan case 58 and a plurality of blades 60 which are rotated by a fan motor (not shown). The fan case 58 is a square frame covering the outer periphery of the fan 56. Alternatively, the fan case 58 may have another geometry as long as air flow is not impeded. The fan case 58 has an opening which is formed on the front side of the vehicle lamp 10, that is, a front side surface 58*a* located on the side of the inner fins 54. When the blades 60 of the fan 56 are rotated, air in the lamp chamber 35 is sucked in an axial direction, and is blown through the opening of the front side surface 58*a* toward the inner fins 54.

The attaching operation of the fan 56 is carried out in such a manner that the fan case 58 comes into contact with the lower surface of the base portion 55. With the fan 56 having the above-described configuration, heat generated from a fan motor and a driving circuit (not shown) thereof is transmitted to the second heat sink 50 via the fan case 58, and is radiated to the outside of the lamp chamber 35 via the outer fins 52. Accordingly, it is possible to prolong the durable years of the fan 56.

The inner fins 54 are formed such that air passing through a gap between the inner fins 54 is guided to the outer lens 34 located on the front side of the second heat sink 50. The inner fins 54 are flat plate fins, and extend radially in a forward direction from the front side surface 58*a* of the fan case 58. Accordingly, as shown in FIG. 2, the gap between the inner fins 54 that is formed at the front side surface 58*a* of the fan case 58 is broadened from the upstream side to the downstream side of the air stream. With the inner fins 54 having the above-described configuration, the blow range of the air blown from the front side surface 58*a* of the fan case 58 is broadened in a transverse direction, and the air is guided to the upper portion of the outer lens 34.

In addition, in this exemplary embodiment, as shown in FIG. 1, first extension member 62 and second extension member 64 are provided above and below the first heat sink 14 in the lamp chamber 35 so that the inner structure of the lamp chamber 35 is not visible. The first extension member 62 provided above the first heat sink 14 is a plate-shaped member, and extends upward from the upper end of the base portion 16 of the first heat sink 14, where the upper end thereof is curved toward the second heat sink 50. A gap having, for example, a height substantially equal to a height of the inner fins 54 is formed between the upper end of the first extension member 62 and the upper surface 48*a* of the lamp body 48 so as not to disturb the flow of the air blown from the inner fins 54 of the second heat sink 50 flows to the upper portion of the outer lens 34.

The second extension member 64 is a plate-shaped member, and is provided between the first heat sink 14 and the bottom surface 48*b*. The second extension member 64 is disposed at the rear side of the base portion 16 of the first heat sink 14, and guides air flowing along the bottom surface 48*b* of the lamp body 48 to the lower end of the first heat sink 14.

Next, a convection current of air in the vehicle lamp 10 according to this exemplary embodiment will be described. In FIGS. 1 and 2, the white arrow indicates an air stream. In the vehicle lamp 10, when light is emitted from the LED 20, heat generated by the light emission is transmitted to the fixed member 26 via the thermal conductive insulating substrate 24 mounted with the LED 20. The heat transmitted to the fixed member 26 is transmitted to the base portion 16 of the first heat sink 14 contacting with the rear end of the fixed member 26. The thermal conductive insulating substrate 24 and the fixed member 26 having the above-described configuration serve as a thermal conductive portion which transmits the heat generated from the LED 20 to the first heat sink 14. The heat transmitted to the base portion 16 of the first heat sink 14 is transmitted to the flat plate fins 18 of the first heat sink 14, and is radiated to the ambient air. The high-temperature air heated by the heat radiated from the flat plate fins 18 of the first heat sink 14 passes through a gap between the flat plate fins 18, and rises along the extension direction of the flat plate fins 18.

The heated air rising via the gap between the flat plate fins 18 of the first heat sink 14 is sucked into the fan 56 provided in the upper surface 48*a* of the lamp body 48, and is blown through the front side surface 58*a* toward the inner fins 54. The blown air passes through the gap between the inner fins 54, and is guided to the upper portion of the outer lens 34. Here, in this exemplary embodiment, since the gap between the inner fins 54 is formed in a broad range from the upstream side to the downstream side of the air stream, the blow range of the air is broadened in a transverse direction, thereby blowing warm air over substantially the entire surface of the outer lens 34.

During the time when the air blown from the fan 56 flows through the gap between the inner fins 54, a heat exchange is carried out between the air and the inner fins 54. The heat transmitted to the inner fins 54 is transmitted to the outer fins 52 via the base portion 55, and is radiated to the air on the outside of the lamp chamber 35. Here, since the extension direction of the outer fins 52 is aligned in a longitudinal direction, air flows through the gap between the outer fins 52 in a direction from the front side of the gap to the rear side thereof in a vehicle travel mode. Accordingly, it is possible to improve the efficiency of the heat radiation since the air heated by the outer fins 52 is not accumulated.

Since the outer lens 34 is exposed to the outside of the vehicle, the temperature of the outer lens 34 is lower than that of the air blown from the inner fins 54. Accordingly, during the time when the air blown from the inner fins 54 flows from the upper portion of the outer lens 34 to the lower portion thereof, the air is cooled by a heat exchange in the outer lens 34. The cooled air flows in a backward direction along the bottom surface 48*b* of the lamp body 48 and contacts with the second extension member 64. Subsequently, the air flows from the lower end of the first heat sink 14 to the gap between the flat plate fins 18, is heated again by the heat generated from the LED 20, and then is sucked by the fan 56.

In addition, as shown in FIG. 1, a part of the air blown from the inner fins 54 is branched by the upper end of the first extension member 62, and flows to the upper end of the first heat sink 14. The branched air flows from the upper end of the first heat sink 14 to the gap between the flat plate fins 18, and is mainly used for a heat exchange with the upper portions of the flat plate fins 18, and then is sucked by the fan 56.

In the vehicle lamp 10 according to this exemplary embodiment, since the air is circulated in the lamp chamber 35 in this manner, it is possible to efficiently radiate the heat generated from the LED 20. In addition, in the vehicle lamp 10, since the heat is transmitted from the air, which is blown into the inner fins 54, to the outer lens 34, it is possible to suppress occurrence of snow or ice attached to the outer surface of the outer lens 34.

In this exemplary embodiment, since the gap between the inner fins 54 is formed in a broad range from the upstream side to the downstream side of the air stream, the blow range of the inner fins 54 is broadened in a transverse direction, thereby blowing the warm air to the broad area of the outer lens 34. Accordingly, since the efficiency of the heat exchange between the heated air and the outer lens 34 is improved, it is possible to further efficiently radiate the heat generated from the LED 20. In addition, it is possible to increase an area of the outer lens 34 capable of suppressing occurrence of snow or ice attached thereto.

Additionally, in this exemplary embodiment, the upper surface 48*a* of the lamp body 48 is provided with the second heat sink 50. A natural convection current of the air, heated by the heat generated from the LED 20, occurs in an upward direction. Accordingly, it is possible to improve the efficiency of heat radiation since the upper surface 48*a* of the lamp body 48 is provided with the second heat sink 50.

In the above-described exemplary embodiment, an LED is used as the light source, but for example, a semiconductor light emitting element such as a semiconductor laser may be used.

In the above-described exemplary embodiment, a lamp unit of a projector type is used as the lamp unit, but a lamp unit of a parabola type or direct projection type may be used.

According to one or more aspects of the present invention, there is provided a vehicle lamp in which a lamp unit using a semiconductor light emitting element as a light source is accommodated in a lamp chamber including an outer lens and a lamp body, the vehicle lamp including a heat sink which has a plurality of outer fins uprightly formed in a base portion of the lamp body and extending toward the outside of the lamp chamber; and a plurality of inner fins uprightly formed in the base portion toward the inside of the lamp chamber; and a fan which blows air in the lamp chamber toward the inner fins, wherein the inner fins are formed so that the air passing through a gap between the inner fins is guided to the outer lens.

With such a configuration, the air in the lamp chamber is heated by the heat generated from the semiconductor light emitting element, and is blown toward the inner fins of the heat sink by the fan, thereby carrying out a heat exchange between the inner fins. The heat transmitted to the inner fins is transmitted to the outer fins via the base portion, and is radiated to the outside of the lamp chamber by the outer fins. In addition, the air passing through the gap between the inner fins is guided to the outer lens, and is cooled by a heat exchange carried out in the outer lens. The cooled air is heated again by the heat generated from the semiconductor light emitting element, and is sucked by the fan. By the circulation of the air in the lamp chamber, it is possible to efficiently radiate the heat generated from the semiconductor light emitting element. In addition, it is possible to suppress occurrence of snow or ice attached to the outer surface of the outer lens by means of the heat transmitted to the outer lens.

In the vehicle lamp having the above-described configuration, an upper surface of the lamp body may be provided with the heat sink. A natural convection current of the air, heated by the heat generated from the semiconductor light emitting element, occurs in an upward direction. Accordingly, it is possible to further efficiently radiate the heat generated from the semiconductor light emitting element in such a manner that the upper surface of the lamp body is provided with the heat sink.

In the vehicle lamp having the above-described configuration, the inner fins may be formed so that the gap between the inner fins is formed in a broad range from the upstream side to the downstream side of an air stream. In this case, since the blow range of the inner fins is broadened, it is possible to blow warm air to the broad area of the outer lens. Accordingly, since the efficiency of heat exchange between the heated air and the outer lens is improved, it is possible to further efficiently radiate the heat generated from the semiconductor light emitting element. In addition, it is possible to broaden an area of the outer lens capable of suppressing occurrence of snow or ice attached thereto.

In the vehicle lamp having the above-described configuration, the fan may be formed so that a fan case covering the outer periphery of the fan contacts with a base portion of the heat sink. In this case, it is possible to radiate heat, generated from a fan motor or a driving circuit used for driving the fan, to the outside of the lamp chamber via the outer fins. Accordingly, it is possible to prolong the durable years of the fan.

According to exemplary embodiments of the invention, it is possible to efficiently radiate heat generated from a semiconductor light emitting element.

While the present invention has been shown and described with reference to certain exemplary embodiments thereof, other implementations are within the scope of the claims. It will be understood by those skilled in the art that various changes in form and details may be made therein without departing from the spirit and scope of the invention as defined by the appended claims.

What is claimed is:

1. A vehicle lamp comprising:

a lamp body comprising a hole portion therein;

an outer lens, attached to the lamp body to form a lamp chamber;

a lamp unit provided in the lamp chamber and comprising a light emitting element serving as a light source;

a heat sink comprising:

a base portion fitted into the hole portion of the lamp body;

a plurality of outer fins disposed on a surface of the base portion and extending outside of the lamp body; and a plurality of inner fins disposed on another surface of the base portion and extending into the lamp chamber; and a fan which moves air in the lamp chamber toward the inner fins, wherein the inner fins are configured such that the air passing between the respective inner fins is guided toward the outer lens.

2. The vehicle lamp according to claim 1, wherein the heat sink is provided in an upper portion of the lamp body.

3. The vehicle lamp according to claim 1, wherein the plurality of inner fins are configured so as to form gaps between respective ones of the plurality of inner fins, wherein each gap between the respective inner fins increases from an upstream side to a downstream side of an air stream of the air.

4. The vehicle lamp according to claim 1, further comprising a fan case which covers an outer periphery of the fan and contacts with the base portion of the heat sink.

5. The vehicle lamp according to claim 1, further comprising another heat sink that is attached to the lamp unit.

6. The vehicle lamp according to claim 5, further comprising a first extension member and a second extension member, the first and second extension members being arranged within the lamp chamber so as to direct air across the other heat sink.

7. The vehicle lamp according to claim 1, wherein the light emitting element is a semiconductor light emitting element.

8. A vehicle lamp comprising:

a lamp body comprising a metal base portion formed therein;

an outer lens, attached to the lamp body to form a lamp chamber;

a lamp unit provided in the lamp chamber and comprising a light emitting element serving as a light source;

a plurality of outer fins disposed on the base portion on an outside of the lamp body;

a plurality of inner fins disposed the base portion and extending into the lamp chamber; and a fan which blows air in the lamp chamber through the inner fins and toward the outer lens.

9. The vehicle lamp according to claim 8, wherein the plurality of inner fins extend radially outward from the fan.

10. The vehicle lamp according to claim 8, further comprising a fan case in which the fan is disposed, wherein the fan case is attached to the base portion so as to thermally communicate with the base portion.

11. The vehicle lamp according to claim 10, wherein the fan case comprises an opening which faces the plurality of inner fins, the plurality of inner fins extend radially outward from the opening of the fan case, and the fan sucks air from the lamp chamber, blows the air through the opening and across the inner fins.

12. The vehicle lamp according to claim 8, further comprising another heat sink that is attached to the lamp unit.

13. The vehicle lamp according to claim 12, further comprising a first extension member and a second extension member, the first and second extension members being arranged within the lamp chamber so as to direct air across the other heat sink.

14. The vehicle lamp according to claim 8, wherein the light emitting element is a semiconductor light emitting element.

15. The vehicle lamp according to claim 1, wherein the other surface of the base portion is provided with the fan.

16. The vehicle lamp according to claim 8, wherein the fan is disposed on the base portion.

17. The vehicle lamp according to claim 1, wherein the fan is disposed on the heat sink.

* * * * *